US007819117B2

(12) United States Patent
Park

(10) Patent No.: US 7,819,117 B2
(45) Date of Patent: Oct. 26, 2010

(54) EMERGENCY OXYGEN MASK

(75) Inventor: Sang Gil Park, Daegu (KR)

(73) Assignee: Sun Yang Tech Co., Ltd., Gyeonggi-do (KR)

( * ) Notice: Subject to any disclaimer, the term of this patent is extended or adjusted under 35 U.S.C. 154(b) by 1068 days.

(21) Appl. No.: 11/482,198

(22) Filed: Jul. 7, 2006

(65) Prior Publication Data

US 2007/0144513 A1 Jun. 28, 2007

(30) Foreign Application Priority Data

Dec. 27, 2005 (KR) ..... 20-2005-0036527 U
Jun. 23, 2006 (KR) ..... 20-2006-0017000 U

(51) Int. Cl.
*A62B 7/10* (2006.01)

(52) U.S. Cl. ..... 128/202.26; 128/205.28; 128/205.12; 128/205.27; 95/139

(58) Field of Classification Search ..... 128/205.12, 128/205.27, 205.28, 914; 95/139
See application file for complete search history.

(56) References Cited

U.S. PATENT DOCUMENTS 3,920,803 A * 11/1975 Boryta ..... 423/579
4,019,509 A * 4/1977 Li et al. ..... 128/202.26
4,163,448 A * 8/1979 Grouard ..... 128/204.26
4,213,453 A * 7/1980 Warncke et al. ..... 128/202.26
4,323,063 A * 4/1982 Fisichella ..... 128/863
4,569,108 A * 2/1986 Schwab ..... 24/17 R
5,029,342 A * 7/1991 Stein et al. ..... 2/8.6
5,191,882 A * 3/1993 Vogliano ..... 128/207.11
5,360,002 A * 11/1994 Smith ..... 128/205.28
5,704,073 A * 1/1998 Sword et al. ..... 2/427
5,706,799 A * 1/1998 Imai et al. ..... 128/205.12
6,123,069 A * 9/2000 Davis ..... 128/202.26
7,296,575 B1 * 11/2007 Radney ..... 128/207.11

* cited by examiner

*Primary Examiner*—Justine R Yu
*Assistant Examiner*—Valerie Skorupa
(74) *Attorney, Agent, or Firm*—Leydig, Voit & Mayer, Ltd.

(57) ABSTRACT

An emergency oxygen mask includes: a respiration part worn on a user's face for supplying oxygen or discharging carbon dioxide or moisture using a pressure difference depending on respiration of the user; a carbon dioxide supply part for supplying the carbon dioxide and the moisture discharged from the respiration part through a carbon dioxide supply hole at a lower surface of the carbon dioxide supply part; an oxygen generating part engaged with an outer surface of the carbon dioxide supply part and having an upper open surface for reacting potassium dioxide in the carbon dioxide supply part with carbon dioxide or moisture to generate oxygen; an oxygen storage part for storing oxygen moved by an oxygen moving part; and filters attached to opposite sides of the oxygen moving part to remove carbon dioxide remaining in the oxygen stored in the oxygen storage part and to lower the temperature and humidity of the oxygen supplied to the respiration part.

10 Claims, 6 Drawing Sheets

EMERGENCY OXYGEN MASK

BACKGROUND OF THE INVENTION

1. Field of the Invention

The present invention relates to an emergency oxygen mask, and more particularly, to an emergency oxygen mask that is easy to wear, has a readily detachable goggle portion, and is capable of converting exhalation of a user into oxygen to allow the user to re-inhale the oxygen.

2. Description of the Related Art

Generally, interior decorations of a building are formed of a large amount of synthetic polymer, which may cause toxic gases to be generated in a fire. Such toxic gasses could potentially kill people within few minutes before they arrive at an exit.

In order to solve this problem, an emergency oxygen mask has been developed to allow a user to wear the oxygen mask and escape the building by inhaling oxygen for several seconds to several minutes. The conventional emergency oxygen mask supplies oxygen using compressed oxygen or chemical reaction involving water.

However, in the case of using compressed oxygen or the chemical reaction, the large size of a pressure vessel for storing compressed oxygen or a water container for storing water is a big problem.

In addition, the emergency oxygen mask includes a plurality of fastening strings to be worn on the head.

Here, a tied part of the strings is disposed at an upper part of the back of the user's head to prevent the mask from sliding down.

However, if the user wears a helmet to protect his/her head, the tied part of the strings requires removal of the helmet in order to put on the emergency oxygen mask, which is inconvenient. Moreover, since the tied part of the strings is disposed at an upper part of the back of the user's head, it is also difficult to wear the helmet on top of the emergency oxygen mask.

SUMMARY OF THE INVENTION

The present invention provides an emergency oxygen mask capable of generating oxygen for a sufficient time in an emergency situation, without carrying water or compressed oxygen.

The present invention also provides an emergency oxygen mask whose volume can be reduced using a simple structure.

The present invention also provides an emergency oxygen mask that can be easily worn together with a helmet, has a readily attachable/detachable goggle portion, and has goggles that can be selectively worn depending on the purpose of use.

The present invention also provides an emergency oxygen mask capable of preventing introduction of toxic gases through a gap between the mask and a wearer's face by increasing adhesion therebetween.

According to an aspect of the present invention, there is provided an emergency oxygen mask including: a respiration part worn on a user's face for supplying oxygen or discharging carbon dioxide or moisture using a pressure difference depending on respiration of the user; a carbon dioxide supply part for supplying the carbon dioxide and the moisture discharged from the respiration part through a carbon dioxide supply hole formed at a lower surface thereof; an oxygen generating part engaged with an outer surface of the carbon dioxide supply part and having an upper open surface to react potassium dioxide ($KO_2$) filled therein with carbon dioxide or moisture to generate oxygen; an oxygen storage part for storing oxygen moved by an oxygen moving part; and filters attached to both sides of the oxygen moving part to remove carbon dioxide remaining in the oxygen stored in the oxygen storage part and lower the temperature and humidity of the oxygen to supply the oxygen to the respiration part.

The respiration part may include a mask having a suction port and a discharge port, and a space disposed adjacent to the mouth and nose of a user to seal the mouth and nose off from the air outside; first and second fastening strings fastened to each other at the back of the user's head to fix the mask; ear guides installed at the first and second fastening strings to prevent the user's ears from interfering with the first and second fastening strings; and a band clip for fastening the first and second fastening strings to each other at a lower part of the back of the user's head.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
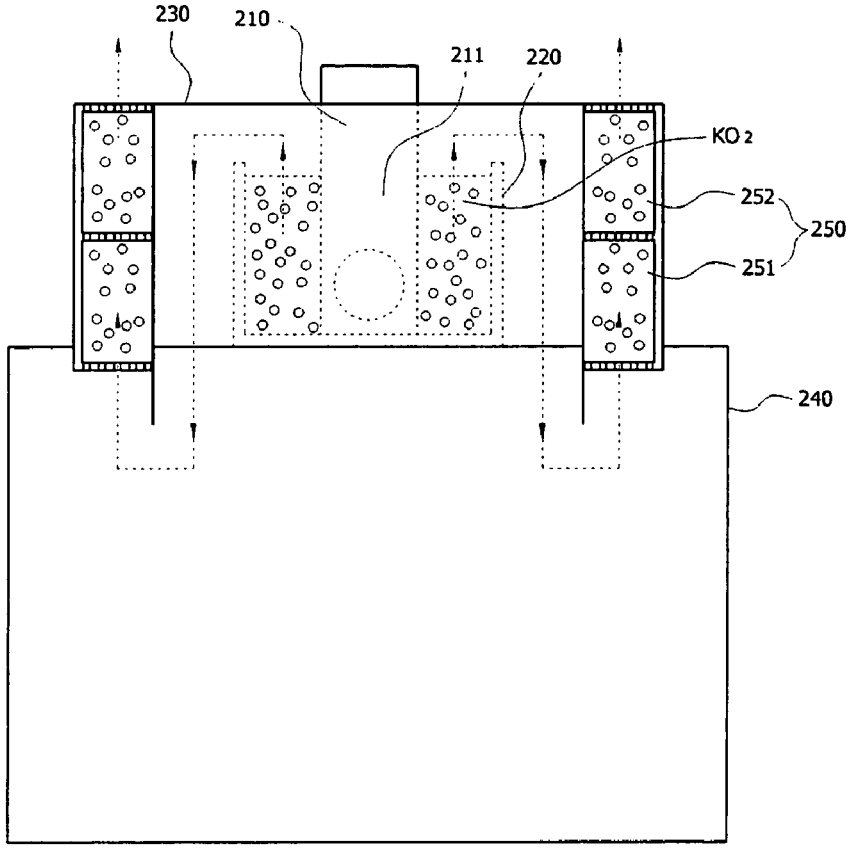
FIG. 1 is a front cross-sectional view of an emergency oxygen generating device in accordance with an exemplary embodiment of the present invention.

The present invention will now be described more fully hereinafter with reference to the accompanying drawings, in which preferred exemplary embodiments of the invention are shown. This invention may, however, be embodied in different forms and should not be construed as limited to the exemplary embodiments set forth herein. Rather, these exemplary embodiments are provided so that this disclosure will be thorough and complete, and will fully convey the scope of the invention to those skilled in the art. Like reference numerals designate like elements throughout the specification.

Exemplary Embodiment 1

Figure 2:
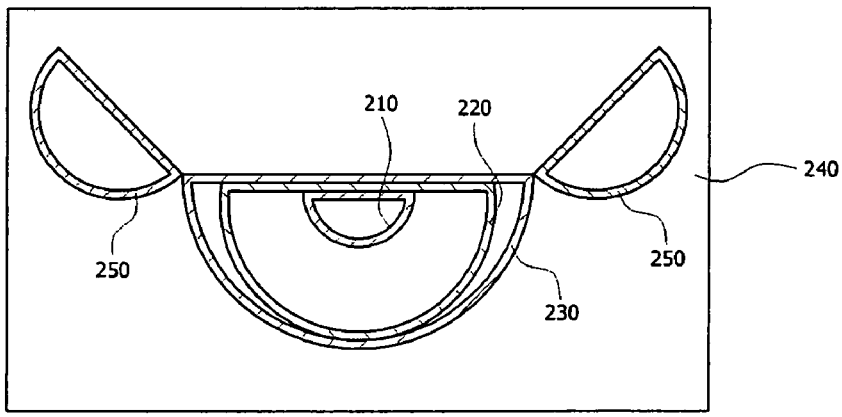
FIG. 2 is a plan cross-sectional view of the emergency oxygen generating device of FIG. 1.
Figure 3:
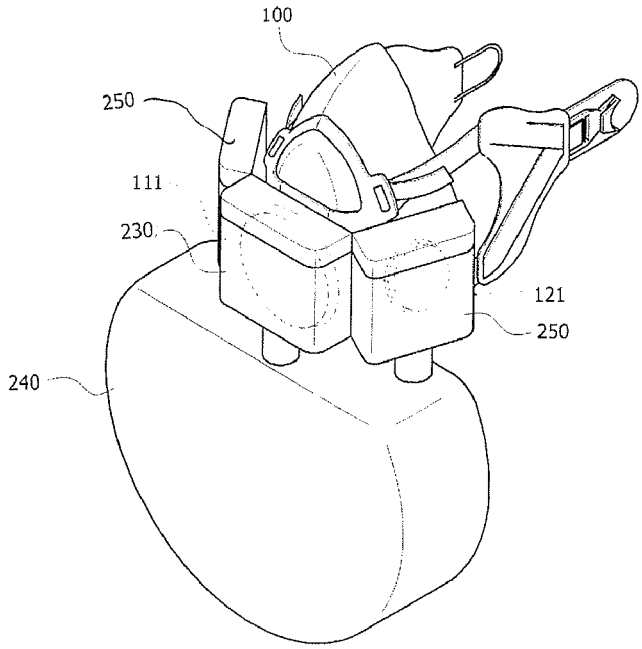
FIG. 3 is a perspective view of an emergency oxygen mask in accordance with an exemplary embodiment of the present invention.

FIG. 1 is a front cross-sectional view of an emergency oxygen generating device in accordance with an exemplary embodiment of the present invention, FIG. 2 is a plan cross-sectional view of the emergency oxygen generating device of FIG. 1, and FIG. 3 is a perspective view of an emergency oxygen mask in accordance with an exemplary embodiment of the present invention.

Referring to FIGS. 1 to 3, an emergency oxygen mask in accordance with an exemplary embodiment of the present invention includes a respiration part 100 for separating the mouth and nose of a user from the outside air and having a suction port and a discharge port, a carbon dioxide introduction part 210 attached to a center of the respiration part 100, an oxygen generating part 220 for reacting carbon dioxide and moisture introduced through the carbon dioxide introduction part 210 with potassium dioxide ($KO_2$) to generate oxygen, an oxygen moving part 230 for moving oxygen generated at the oxygen generating part 220 to an oxygen storage part 240 attached to a lower part of the oxygen generating part 220, and filters 250 disposed at an upper part of the oxygen storage part 240 and side surfaces of the oxygen moving part 230 to supply oxygen purified by removing non-reacted carbon dioxide and absorbing moisture to the respiration part 100.

Hereinafter, the constitution and operation of the emergency oxygen mask in accordance with an exemplary embodiment of the present invention will be described in detail.

First, the carbon dioxide introduction part 210, the oxygen generating part 220, and the oxygen moving part 230 have different sizes of semi-cylindrical shapes, flat parts of which are in contact with a user's face, and curved parts of which are exterior parts.

In addition, the semi-cylindrical filters 250 are fastened to both sides of the oxygen moving part 230 and bent with respect to the oxygen moving part 230 by a predetermined angle.

Such a bent structure allows the mask to be adhered to a user's face and increases the capacity of the mask to generate a sufficient amount of oxygen during the escape time while making its size compact.

Carbon dioxide contained in the exhalation of the user who wears the respiration part 100 is introduced into the carbon dioxide introduction part 210.

Check valves 111 and 121 are installed at the discharge port and the suction port of the respiration part 100 to be opened/closed depending on a pressure difference therebetween. Therefore, the check valve 111 is opened and the check valve 121 is closed when the user exhales, and the check valve 111 is closed and the check valve 121 is opened when the user inhales.

A carbon dioxide inlet hole 211 is formed at a lower end of the carbon dioxide introduction part 210 and buried by potassium dioxide ($KO_2$) filled in the oxygen generating part 230 to a predetermined depth.

The oxygen generating part 230 has an upper open end and is filled with potassium dioxide ($KO_2$). Potassium dioxide ($KO_2$) reacts with carbon dioxide ($CO_2$) to generate oxygen ($O_2$) as shown in Chemical Formula 1.

$$2CO_2+4KO_2+2K_2CO_3+3O_2+\text{heat} \qquad \text{Chemical Formula 1}$$

In addition, potassium dioxide (KO2) reacts with moisture to generate oxygen as shown in Chemical Formula 2.

$$4KO_2+2H_2O \rightarrow 2KOH+3O_2+\text{heat} \qquad \text{Chemical Formula 2}$$

That is, the emergency oxygen mask in accordance with the present invention generates oxygen by reacting carbon dioxide and moisture contained in the exhalation of the user with potassium dioxide.

The resultant material, i.e., 2KOH, generates oxygen through reaction as shown in Chemical Formula 3. Through the dual reaction, it is possible to generate a sufficient amount of oxygen for respiration using carbon dioxide contained in the exhalation of a user.

$$2KOH+4CO_2 \rightarrow K_2CO_3+3O_2+H_2O \qquad \text{Chemical Formula 3}$$

Here, the potassium dioxide ($KO_2$) may be a granule having a particle diameter of 2 to 4 mm. A catalyst may be added to promote the reactions of Chemical Formulae 1, 2 and 3.

In addition, since flow of the carbon dioxide passing through the potassium dioxide is countercurrent, there is no cluster generated in the reaction between the carbon dioxide and the potassium dioxide, thereby making the reaction effective.

The oxygen generated by the reactions of Chemical Formulae 1 and 2 has a temperature of about 40° C. or more, which is difficult to directly inhale.

The generated oxygen is moved through the oxygen moving part 230 to be stored in the oxygen storage part 240. The oxygen moving part 230 has a semi-cylindrical structure, a bottom surface of which is open, to allow the oxygen generated at the oxygen generating part 220 to move downward to be stored in the oxygen storage part 240.

At this time, in order to reduce the volume of the oxygen generating device of the present invention, a path through which the oxygen moves is defined by an outer periphery of the oxygen generating part 220. That is, a front surface of the oxygen generating part 220 is in contact with a rear surface of the oxygen moving part 230.

Therefore, the oxygen storage part 240 functions to slightly lower the temperature of the oxygen as well as store the oxygen.

The oxygen stored in the oxygen storage part 240 is introduced into the filters 250 by exhalation of the user and enters into the respiration part 100 through the suction port, thereby enabling the user to breathe and escape the emergency.

Each of the filters 250 includes a carbon dioxide adsorption part 251 for removing carbon dioxide remaining in oxygen supplied from the oxygen storage part 240, and a moisture removal part 252 for removing moisture from the oxygen from which the carbon dioxide is removed.

The carbon dioxide adsorption part 251 is separated from the moisture removal part 252 by a diaphragm 253, through which air can pass, and filled with soda lime.

The soda lime is a mixture of sodium hydroxide, potassium hydroxide, and calcium hydroxide, and functions to absorb carbonic acid gas.

As described above, the carbon dioxide is almost entirely removed by the carbon dioxide adsorption part 251 to provide the user with breathable air.

In addition, the moisture removal part 252 is filled with silica gel, which is formed of porous particles having silicon dioxide as a main component to remove moisture from the generated oxygen.

Here, by removing the moisture, it is possible to lower the temperature of the oxygen inhaled by the user.

That is, the emergency oxygen mask in accordance with the present invention is capable of generating oxygen using carbon dioxide contained in the exhalation of a user, lowering the temperature of the oxygen, and enabling it to be re-inhaled. Also, the emergency oxygen mask according to the present invention has a simple structure enabling it to be easily stored and carried.

The filters 250 are semi-cylindrical structures fastened to both sides of the oxygen moving part 230 and bent with respect to the oxygen moving part 230 by a predetermined angle, and lower parts of the filters 250 are partially inserted into the oxygen storage part 240 and fixed thereto.

Therefore, rear surfaces of the filters 250 and the oxygen moving part 230 can be in close contact with a user's face, and front surfaces thereof have curved shapes to enable safe escape without hooking onto obstacles.

Exemplary Embodiment 2

Figure 4:
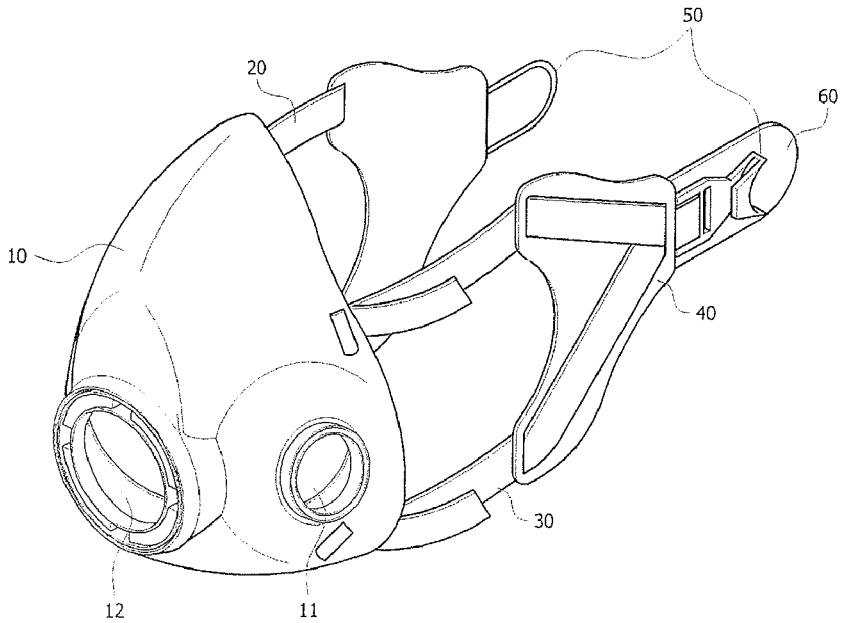
FIG. 4 is a perspective view of a respiration part of an emergency oxygen mask in accordance with an exemplary embodiment of the present invention.

FIG. 4 is a perspective view of a respiration part 100 of the emergency oxygen mask in accordance with the present invention.

Referring to FIG. 4, the respiration part 100 of the emergency oxygen mask in accordance with the present invention hermetically seals around the mouth and nose of a user's face, and includes a mask 10 having a suction port 11 and a discharge port 12, fastening strings 20 and 30 fastened to both sides of the mask 10 at both ends and spaced apart from each other by a predetermined distance, and ear guides 40 through which the fastening strings 20 and 30 are partially inserted to maintain their spacing, band clips 50 disposed at the center of each of the fastening strings 20 and 30, and a pad 60 disposed inside the band clips 50 to be engaged with a center of the fastening string 30 to prevent the suction port 11 from being blocked and the fastening strings 20 and 30 from sliding down from a user's head.

The constitution and operation of the respiration part 100 of the emergency oxygen mask in accordance with an exemplary embodiment of the present invention will be described in detail below.

First, the mask 10 has a shape sufficient to provide a space around the nose and mouth. The mask 10 may employ a structure that can be in close contact with the user's nose and mouth to prevent leakage of oxygen through the mask 10 and introduction of air from outside into the mask 10, regardless of its shape.

In addition, the mask 10 includes the discharge port 12 for exhausting carbon dioxide exhaled by the user, and the suction port 11 for sucking oxygen. Check valves may be installed at the discharge port 12 and the suction port 11.

The fastening strings 20 and 30 are fastened to both sides of the mask 10, respectively.

Each of the fastening strings 20 and 30 may be a single string, both ends of which are fastened to either side of the mask 10 at predetermined positions, spaced apart from each other.

A fluorescent material or a fluorescent sheet may be applied on or adhered to the fastening strings 20 and 30 so that the user can readily recognize the fastening strings 20 and 30 and a rescuer can readily recognize the user wearing the mask 10, even in the dark, due to the fire or disaster.

The ear guides 40 are installed at center parts between both ends of the fastening strings 20 and 30, which are fastened to the mask 10.

When the user wears the mask 10, the ear guides 40 are positioned behind the user's ears, and both ends of the fastening strings 20 and 30 engaged with the mask 10 maintain their gaps, thereby preventing the fastening strings 20 and 30 from interfering with the user's ears.

In addition, the ear guides 40 keep the user's ears always open so that the user can hear normally during the fire or disaster and rapidly escape by following a rescuer's guidance.

Further, the band clip 50 is engaged with center parts of the fastening strings 20 and 30 to be fastened to each other.

Figure 5:
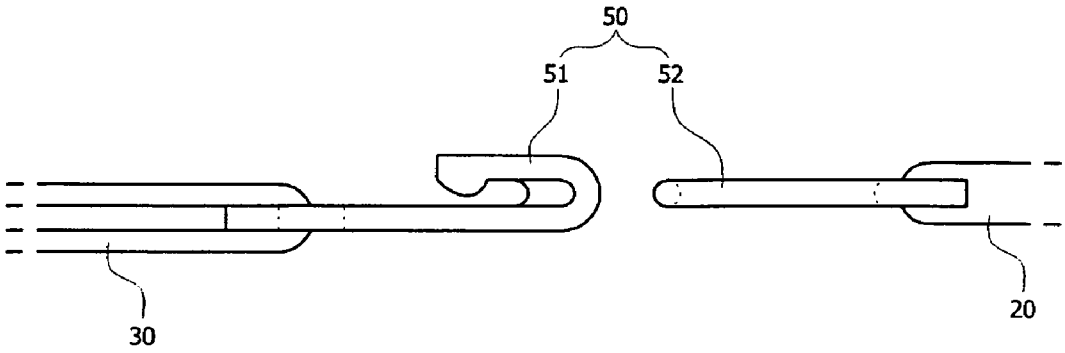
FIG. 5 is a side view of a band clip in accordance with an exemplary embodiment of the present invention.

FIG. 5 is a side view of the band clip 50 in accordance with an exemplary embodiment of the present invention.

Referring to FIG. 5, the band clip 50 includes a hook part 51 fastened to the center of the fastening string 30 at one end and having a bent hook at the other end, and a loop part 52 fastened to the center of the fastening string 20 and having a loop hooked by the hook of the hook part 51.

The hook part 51 may have a projection extending inward so that the loop part 52 cannot be readily separated therefrom.

In addition, the pad 60 is installed at a rear surface of the band clip 50 to prevent the fastening string 30 from sliding down. The pad 60 is formed of rubber which may function to seal the suction port 11 when the mask 10 is stored.

Figure 6:
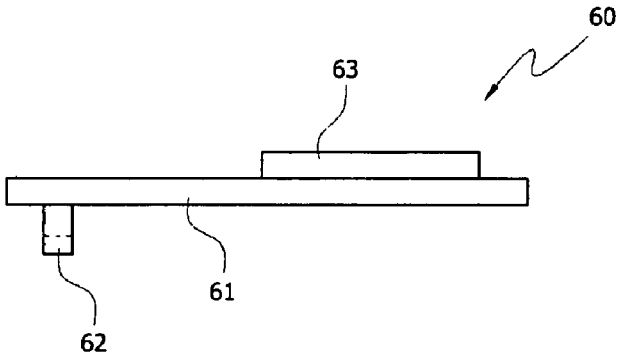
FIG. 6 is a side view of a pad in accordance with an exemplary embodiment of the present invention.

FIG. 6 is a side view of the pad 60 in accordance with an exemplary embodiment of the present invention.

Referring to FIG. 6, the pad 60 includes an oval main body 61, a fastening part 62 projecting from a bottom surface of the main body 61 and through which a center part of the fastening string 30 is fixedly inserted, and a circular suction port sealing part 63 projecting opposite the fastening part 62.

The reason for forming the suction port sealing part 63 at the pad 60 is to prevent deterioration of a compound for converting carbon dioxide into oxygen in an oxygen generator when the oxygen generator filled with the compound is installed adjacent to the suction port of the mask 10.

Meanwhile, a method of wearing an emergency oxygen mask in accordance with an exemplary embodiment of the present invention includes adhering a mask 10 to the mouth and nose of a user's face, pulling both sides of fastening strings 20 and 30 beyond the back of the user's head, and fastening a hook part 51 and a loop part 52 of a band clip 50 to fix the emergency oxygen mask to the user's head.

Here, since the user can wear the emergency oxygen mask even while wearing the helmet, the ear guides 40 allow the fastening strings 20 and 30 to not interfere with the user's ears, thereby enabling the emergency oxygen mask to be readily worn.

In addition, since the band clip 50 for interconnecting the fastening strings 20 and 30 is disposed at a lower part of the back of the user's head, the emergency oxygen mask can be worn by the user regardless of the helmet.

Exemplary Embodiment 3

Figure 7:
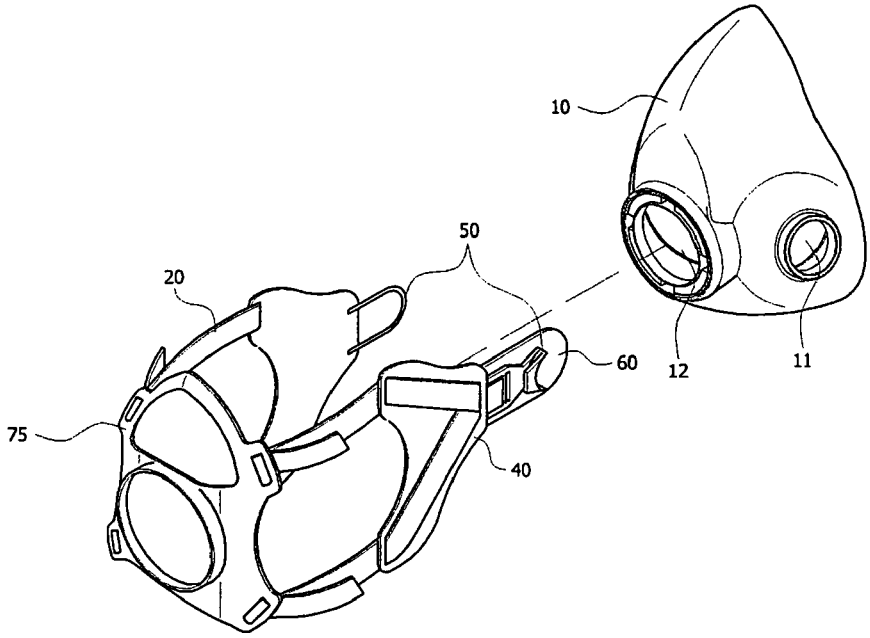
FIG. 7 is an exploded perspective view of an emergency oxygen mask in accordance with another exemplary embodiment of the present invention.

FIG. 7 is an exploded perspective view of an emergency oxygen mask in accordance with another exemplary embodiment of the present invention.

Referring to FIG. 7, fastening strings 20 and 30 are fastened to a mask guide 75 surrounding a mask 10, rather than directly fastened to the mask 10.

The mask guide 75 partially covers an outer surface of the mask 10 and has holes corresponding to a suction port 11 and a discharge port 12 of the mask 10.

The mask guide 75 is formed of a nonflammable or flame retardant material and is biased against the user's face by the fastening strings 20 and 30 to bring the mask 10 into close contact with the user's face.

In particular, the mask guide 75 may use a soft material, unlike the mask 10, to prevent deformation or damage of the mask 10 due to pulling of the fastening strings 20 and 30.

Exemplary Embodiment 4

Figure 8:
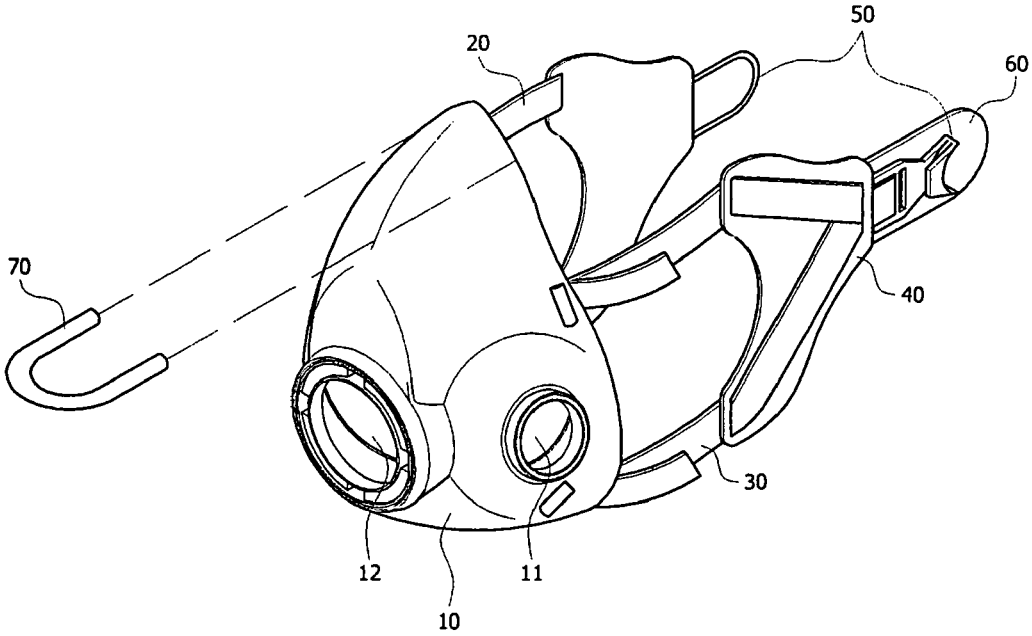
FIG. 8 is a perspective view of a respiration part of an emergency oxygen mask in accordance with another exemplary embodiment of the present invention.

FIG. 8 is a perspective view of a respiration part of an emergency oxygen mask in accordance with another exemplary embodiment of the present invention.

Referring to FIG. 8, the emergency oxygen mask in accordance with another exemplary embodiment of the present invention further includes a clip 70 for adhering the mask 10 to the bridge of a user's nose, in addition to the constitution of Exemplary embodiment 1.

The clip 70 is bent at its center to provide an appropriate restitution force to both ends thereof.

The clip 70 may be formed of synthetic resin or metal.

Since the bridge of the nose may be different in shape and height depending on the user, when the bridge of the nose is too high or low, too thick or thin, the mask 10 may not be tightly adhered to the user's face.

While toxic gases such as carbon oxide generated during the fire may be introduced into the mask 10 when the mask 10 is not closely adhered to the user's face, the clip 70 makes the mask 10 closely adhere to the bridge of the nose to prevent introduction of air from outside into the mask 10.

Exemplary Embodiment 5

Figure 9:
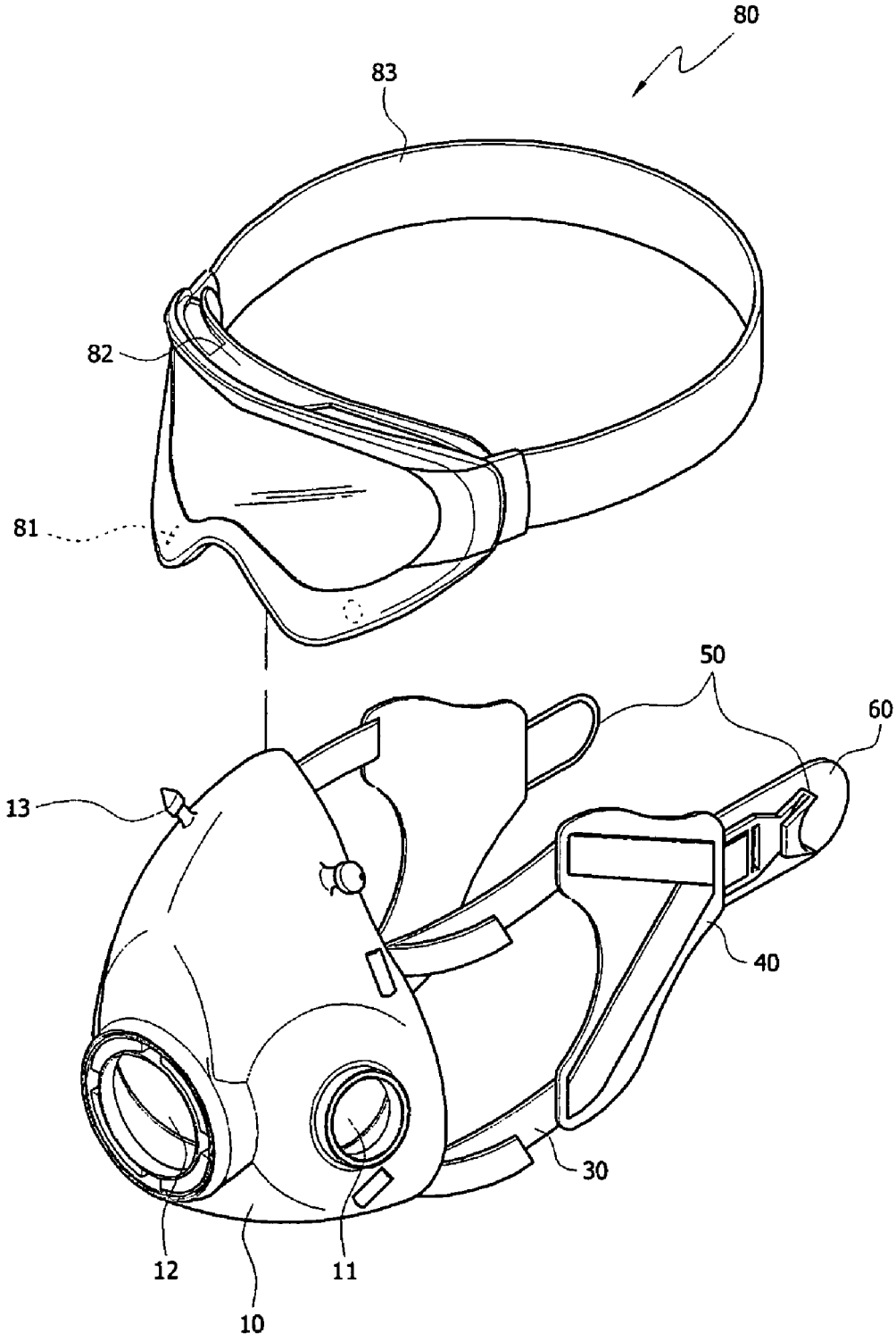
FIG. 9 is an exploded perspective view of a respiration part of an emergency oxygen mask in accordance with another exemplary embodiment of the present invention.

FIG. 9 is an exploded perspective view of a respiration part 100 of an emergency oxygen mask in accordance with another exemplary embodiment of the present invention.

Referring to FIG. 9, the respiration part 100 of the emergency oxygen mask of the present invention includes coupling projections 13 extending from upper parts of both sides of the mask 10. The coupling projections 13 are inserted into coupling holes 81 formed at a lower part of a goggle part 80 to fasten the goggle part 80 to the mask 10.

The goggle part 80 includes a goggle main body 82 for protecting user's eyes, and a goggle fastening string 83 engaged with both sides of the goggle main body 82 to fix the goggle part 80 to the user's head.

The goggle fastening string 83 may be formed of a single string without any connection part, may have the same structure as the band clip 50, both ends of which are fastened to each other, or may use another connection means for fixing the goggle part 80.

The goggle main body 82 may have various structures, such as a structure including a groove formed at a portion corresponding to the bridge of the nose, the groove having a small width sufficient to adhere the mask 10 to the bridge of the nose.

That is, it is possible to prevent leakage of the user's breath to the goggle part 80 through a space between the mask 10 and the bridge of the user's nose, thereby preventing the goggle part 80 from getting steamed up.

Each of the coupling projections 13 extending from the mask 10 has upper and lower ends, and the upper end has a larger diameter than the lower end. The upper end has sloped surfaces at its upper and lower parts.

The reason for this is so that the goggle part 80 can be more readily attached or detached by the coupling projections 13.

As described above, the goggle part 80 of the emergency oxygen mask in accordance with another exemplary embodiment of the present invention can be detachably installed at the mask, thereby enabling selective use of the goggle part 80 according to practical application of the emergency oxygen mask.

Exemplary Embodiment 6

Figure 10:
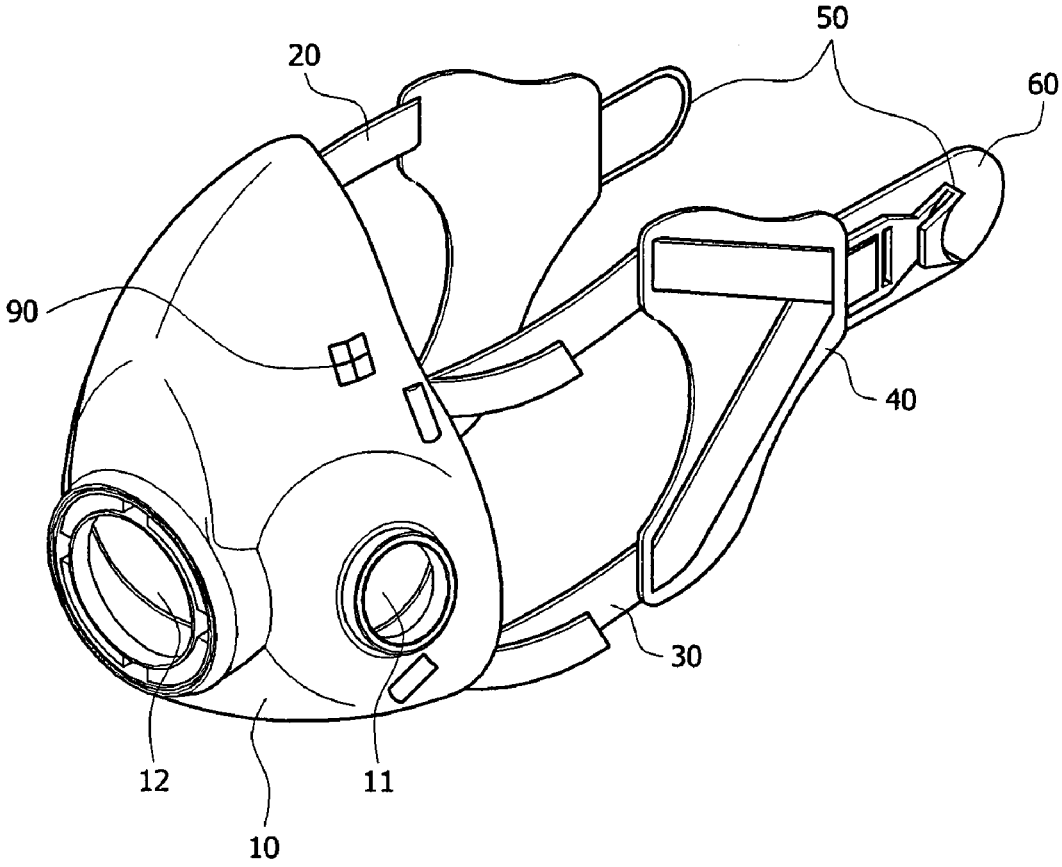
FIG. 10 is a perspective view of an emergency oxygen mask in accordance with another exemplary embodiment of the present invention.

FIG. 10 is a perspective view of an emergency oxygen mask in accordance with another exemplary embodiment of the present invention.

Referring to FIG. 10, a respiration part of the emergency oxygen mask in accordance with another exemplary embodiment of the present invention further includes a solar cell 90.

The solar cell 90 may be selectively exposed to the exterior, even in a packaged state, maintaining a charged state by sunlight or indoor illumination.

The power charged in the solar cell 90 may be used for an amplifier for amplifying a user's voice or an emergency light attached to the emergency oxygen mask.

While the emergency oxygen mask using the sound amplifier or the emergency light has a direct current power source such as a dry battery, the lifespan of the emergency oxygen mask is about three years. Therefore, when a storage period of the emergency oxygen mask is too long, the direct current power source may naturally lose its charge.

Since the emergency oxygen mask in accordance with the current exemplary embodiment of the present invention uses power provided by the solar cell, it is possible to increase reliability by preventing natural discharge during storage of the emergency oxygen mask.

As can be seen from the foregoing, an emergency oxygen mask in accordance with the present invention employs a simple structure to generate oxygen using carbon dioxide contained in the exhalation of a user, and condition the generated oxygen into a temperature and humidity appropriate for inhalation. Thereby, the emergency oxygen mask of the present invention supplies a sufficient amount of oxygen during escape to reduce casualties and improve storage and carrying convenience.

In addition, since the emergency oxygen mask can be readily worn on top of a helmet, it is possible to reduce time taken to put on the emergency oxygen mask, thus increasing user safety.

Further, the emergency oxygen mask employs ear guides to prevent fastening strings from interfering with the user's ears and ensure sufficient hearing ability, thereby improving wearing convenience and facilitating rapid escape from the emergency situation according to the guidance of rescuers.

Furthermore, it is possible to enlarge an application range and reduce additional expense by employing a readily detachable goggle part.

In addition, it is possible to safely protect the user from the air outside contaminated due to a fire, etc. by employing an adhering means for closely adhering the mask to the user's face.

Further, the emergency oxygen mask may employ a power source using sunlight or indoor illumination to amplify the user's voice or power an emergency light, thereby improving management convenience, enabling easy recognition of an escape path in emergency, and facilitating communication to rescuers.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An emergency oxygen mask consuming carbon dioxide and moisture exhaled by a user of the emergency oxygen mask and generating oxygen for inhalation by the user of the emergency oxygen mask, the emergency oxygen mask comprising:

a mask part mountable on the face of the user and, when mounted on the face of the user, defining a sealed space adjacent to the mouth and the nose of the user, the mask part including an exhalation port and a first check valve in fluid communication with the exhalation port and that is opened by exhalation of the user and closed by inhalation of the user, for discharging carbon dioxide and moisture produced by respiration of the user, and an inhalation port and a second check valve in fluid communication with the inhalation port and that is closed by the exhalation of the user and opened by the inhalation of the user;

a carbon dioxide transmission container attached at a central location of the mask part for transmitting the carbon dioxide and moisture flowing through the first check valve;

an oxygen generating container having an outer circumferential surface and containing particulate potassium dioxide, wherein the carbon dioxide transmission container opens to and is in fluid communication with the particulate potassium dioxide for contacting and reacting the carbon dioxide and moisture with the potassium dioxide to generate gaseous reaction products including oxygen that flow in a first direction through the oxygen generating container;

an oxygen transmission container having, in cross-section, a semi-cylindrical shape, including an outer surface, and defining a flow path located between the outer circumferential surface of the oxygen generating container and the outer surface of the oxygen transmission container for flow of the gaseous reaction products including oxygen from the oxygen generating container in a second direction, opposite the first direction, wherein the oxygen generating container is disposed within the oxygen transmission container so that a surface of the oxygen generating container is in contact with a surface of the oxygen transmission container;

an oxygen storage container attached to and in fluid communication with the oxygen transmission container and storing the gaseous reaction products and oxygen flowing in the second direction from the oxygen transmission container; and first and second filters in fluid communication with the oxygen storage container, having, in cross-section, semi-cylindrical shapes, attached to opposite lateral sides of the oxygen transmission container, and inclined along the opposite lateral sides toward each other, wherein each of the first and second filters includes soda-lime for removing carbon dioxide from the gaseous reaction products including oxygen flowing from the oxygen storage container, and silica gel for removing moisture and reducing temperature of the gaseous reaction products including oxygen flowing from the oxygen storage container, the first and second filters being in fluid communication with the mask part for supplying oxygen from the first and second filters, through the second check valve, to the inhalation port for inhalation by the user.

2. The emergency oxygen mask according to claim 1 wherein the mask part comprises:

first and second fastening strings having ends spaced apart by a predetermined distance and extending from respective sides of the mask part for fastening to each other and contact with the head of the user for fixing the mask part to the head of the user;

ear guides located proximate the first and second fastening strings for preventing the ears of the user from interfering with first and second fastening strings;

a band clip fixed to the first and second fastening strings for fastening the first and second fastening strings to each other at the head of the user;

a mask guide having sides spaced apart from each other and to which the ends of the first and second fastening strings are fixed and adhered to an outer surface of the mask part to hold the mask part against the face of the user;

a pad engaged with a central part of one of the first and second fastening strings to prevent sliding of the first and second fastening strings, when fastened to each other, and sealing the inhalation port when the mask is not in use; and a bent clip for holding the mask part against the bridge of the nose of the user.

3. The emergency oxygen mask according to claim 2 including a plurality of coupling projections extending outward from the mask part and goggles including coupling recesses for engaging the coupling projections to hold the goggles onto the mask part.

4. The emergency oxygen mask according to claim 3 wherein the band clip includes a hook for engaging a central part of one of the first and second fastening strings and a loop on the other of the first and second fastening strings for detachably engaging the hook, the hook including a projection for inhibiting detaching of the hook from the loop.

5. The emergency oxygen mask according to claim 4 wherein the pad includes:

a main body having a oval shape;

a fastening part projecting from a bottom surface of the main body and through which a central part of one of the first and second fastening strings may be fixedly inserted; and a central inhalation port sealing part projecting in a direction opposite the fastening part.

6. The emergency oxygen mask according to claim 5 comprising a solar cell attached to the mask part and generating electricity in response to incident light for operating an amplifier for amplifying the voice of the user.

7. The emergency oxygen mask according to claim 2 wherein the band clip includes a hook for engaging a central part of one of the first and second fastening strings and a loop on the other of the first and second fastening strings for detachably engaging the hook, the hook including a projection for inhibiting detaching of the hook from the loop.

8. The emergency oxygen mask according to claim 2 wherein the pad includes:

a main body having a oval shape;

a fastening part projecting from a bottom surface of the main body and through which a central part of one of the first and second fastening strings may be fixedly inserted; and a central inhalation port sealing part projecting in a direction opposite the fastening part.

9. The emergency oxygen mask according to claim 1 including a plurality of coupling projections extending outward from the mask part and goggles including coupling recesses for engaging the coupling projections to hold the goggles onto the mask part.

10. The emergency oxygen mask according to claim 1 comprising a solar cell attached to the mask part and generating electricity in response to incident light for operating an amplifier for amplifying the voice of the user.

* * * * *